United States Patent [19]

Valoh

[11] 4,103,930

[45] Aug. 1, 1978

[54] HEEL HOLDER FOR SKI BINDINGS

[75] Inventor: Alfons Valoh, Vienna, Austria

[73] Assignee: TMC Corporation, Baar, Zug, Switzerland

[21] Appl. No.: 769,269

[22] Filed: Feb. 16, 1977

[30] Foreign Application Priority Data

Feb. 18, 1976 [AT] Austria ..... 1142/76

[51] Int. Cl.[2] ..... A63C 9/08

[52] U.S. Cl. ..... 280/614; 280/631

[58] Field of Search ..... 280/631, 632, 634, 626, 280/623, 614

[56] References Cited

U.S. PATENT DOCUMENTS

| | | | |
|---|---|---|---|
| 3,778,073 | 12/1973 | Salomon | 280/632 |
| 3,845,964 | 11/1974 | Johnson | 280/631 X |
| 3,933,363 | 1/1976 | Schwerzer et al. | 280/631 |
| 3,966,218 | 6/1976 | Beyl | 280/631 X |
| 3,989,274 | 11/1976 | Weigl | 280/634 |
| 4,027,897 | 6/1977 | Hildebrand | 280/631 |

*Primary Examiner*—Joseph F. Peters, Jr.
*Assistant Examiner*—Gene A. Church
*Attorney, Agent, or Firm*—Blanchard, Flynn, Thiel, Boutell & Tanis

[57] ABSTRACT

A heel holding device for ski bindings capable of holding the heel of the ski boot in either a fixed position for downhill skiing or in a manner which permits a relative movement of the heel with respect to the ski to enable the skier to cross-country ski. The heel holder comprises a housing which is supported on a base plate and has a sole holder hingedly connected thereto and held in either the opened or closed position by at least one pivotal locking arm which is initially tensioned by means of a spring force and engages a slideway member pivotally arranged in the housing. An adjustable control mechanism is provided for controlling both the initial tension of the spring which loads the locking arm and also the angle of pitch of a slideway surface on the slideway member.

11 Claims, 11 Drawing Figures

Fig. 9
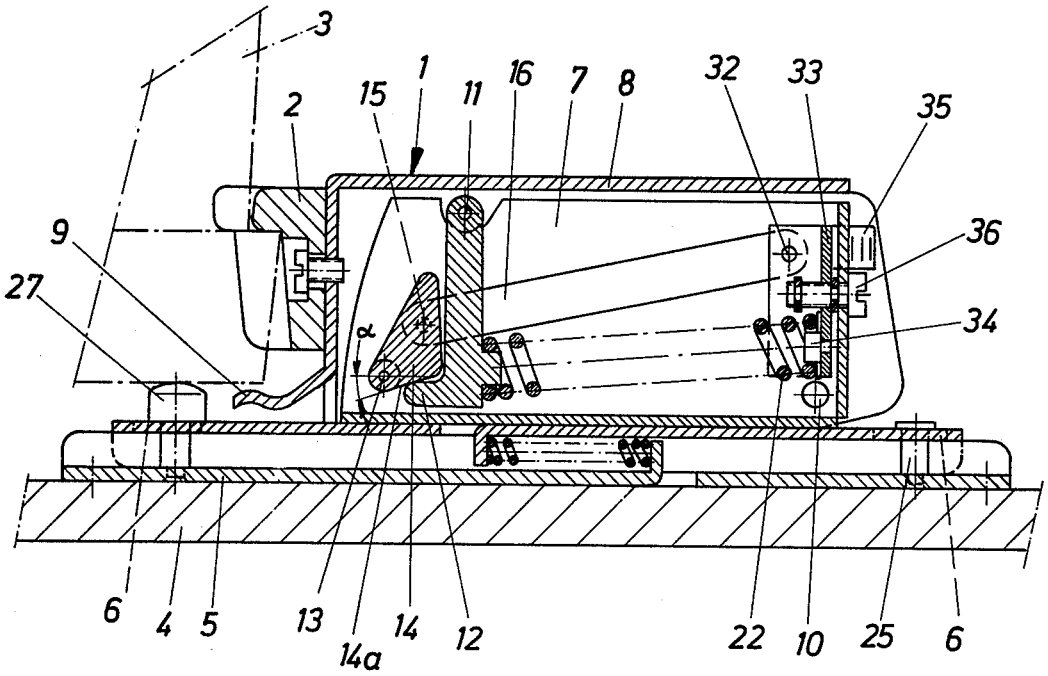
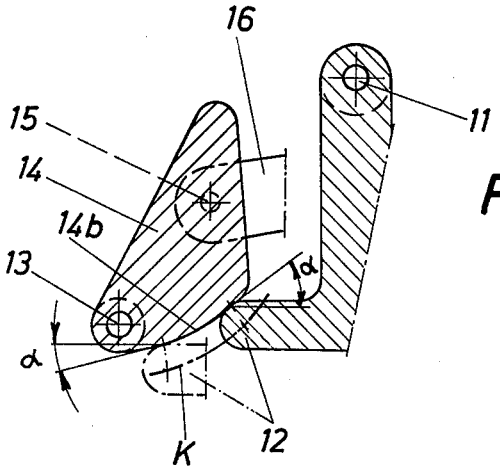
Fig.10
Fig. 11
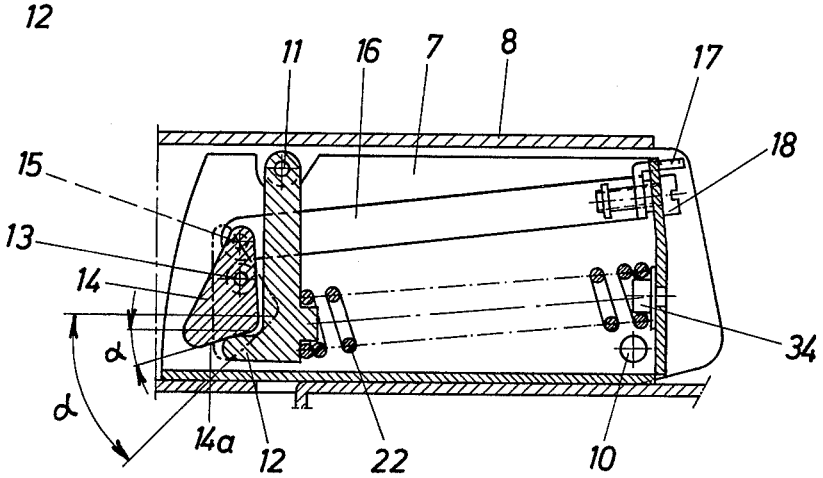

HEEL HOLDER FOR SKI BINDINGS

FIELD OF THE INVENTION

The invention relates to a heel holder for ski bindings comprising a housing which is movably supported, if desired in longitudinal direction of the ski on a base plate, to which housing a sole holder is hingedly secured and held in the closed or the open position by at least one swingable locking arm which is initially tensioned by spring force and engages a slideway member which is arranged on the housing.

BACKGROUND OF THE INVENTION

Common heel holders in ski bindings are used for fixing the ski boot to a pivotal sole holder which is held in a closed position by a locking mechanism. This locking mechanism consists in most cases of a pretensioned locking part which engages a stationary holding part. The release or holding force is thereby adjusted in most cases through the change of the pretension of the spring-loaded locking part. Such constructions have the disadvantage that they rigidly hold the ski boot and have practically no elasticity, and can thus absorb no shock loads.

The basic purpose of the invention is now to provide a heel holder which is simple in structure and is maintenance free and wear-free in operation and which is free of the listed disadvantages.

For this it is inventively suggested that both the initial tension or pretension of the spring which loads the locking arm and also the angle of pitch of a surface on a slideway member be adjustable.

Such a construction has in particular the advantage that the release path of the sole holder, which release path effects the height of elasticity, is adjustable by changing the angle of pitch of a surface on the slideway member and the release or the holding force of the sole holder is adjustable also by changing the initial tension of the spring. In this manner it is assured in a structurally simple manner that the ski binding can be individually adjusted to the respective skiing capability or the body structure of the skier and also to the respective slope conditions. It is thereby advantageous, if the slideway surface is constructed on a slideway member which is rotatably supported in the housing, which slideway member engages an adjusting member. The locking arm thereby advantageously has an L-shape and grips in the closed position behind the slideway member.

A preferred exemplary embodiment of the invention is characterized by a stop part being supported on the housing, which stop part is rotatable or movable into the release path of the locking arm. This has the advantage that the binding, by adjusting a high elasticity and low release force, can be moved into a kind of a cross-country position, and thus permit the skier to have a limited freedom of movement of the heel. This makes walking easier.

BRIEF DESCRIPTION OF THE DRAWINGS

Further details of the invention will be discussed more in detil hereinafter with reference to the exemplary embodiments illustrated in the drawings, without any limiting inference being attributed thereto.

In the drawings:

FIG. 9 is a central sectional view of a further exemplary embodiment;

FIG. 10 is a detailed view of the locking arm and of the slideway member; and FIG. 11 illustrates a modification of the slideway member.

DETAILED DESCRIPTION

Figure 1:
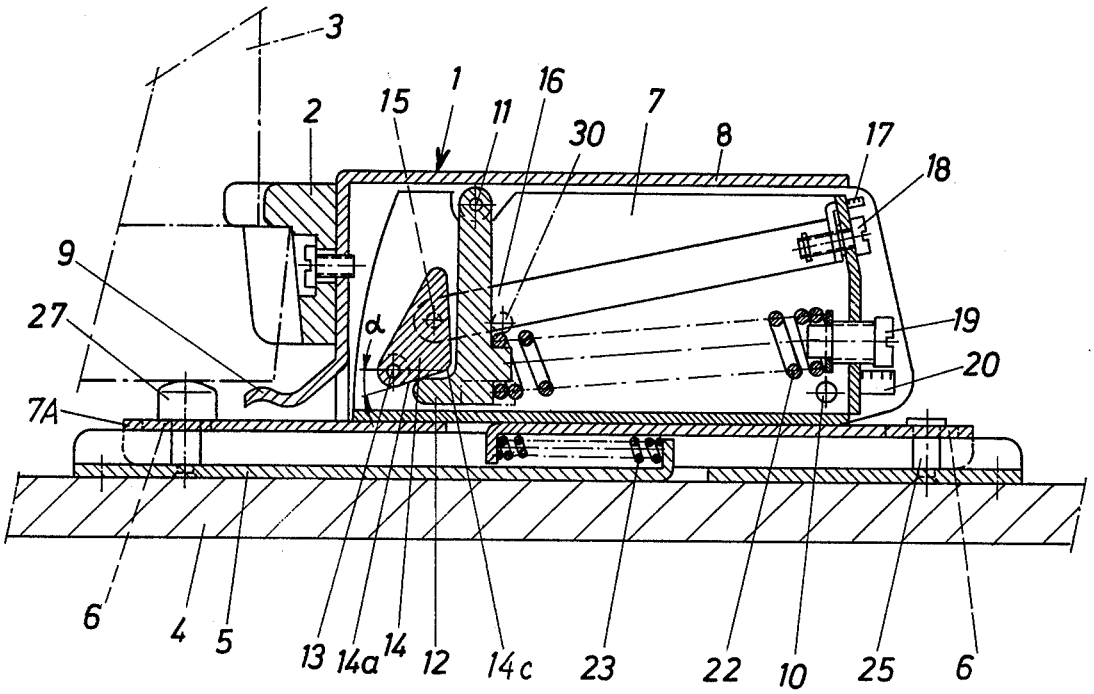
FIG. 1 illustrates a longitudinal central sectional view of a ski binding in the downhill condition of use and embodying the invention.
Figure 2:
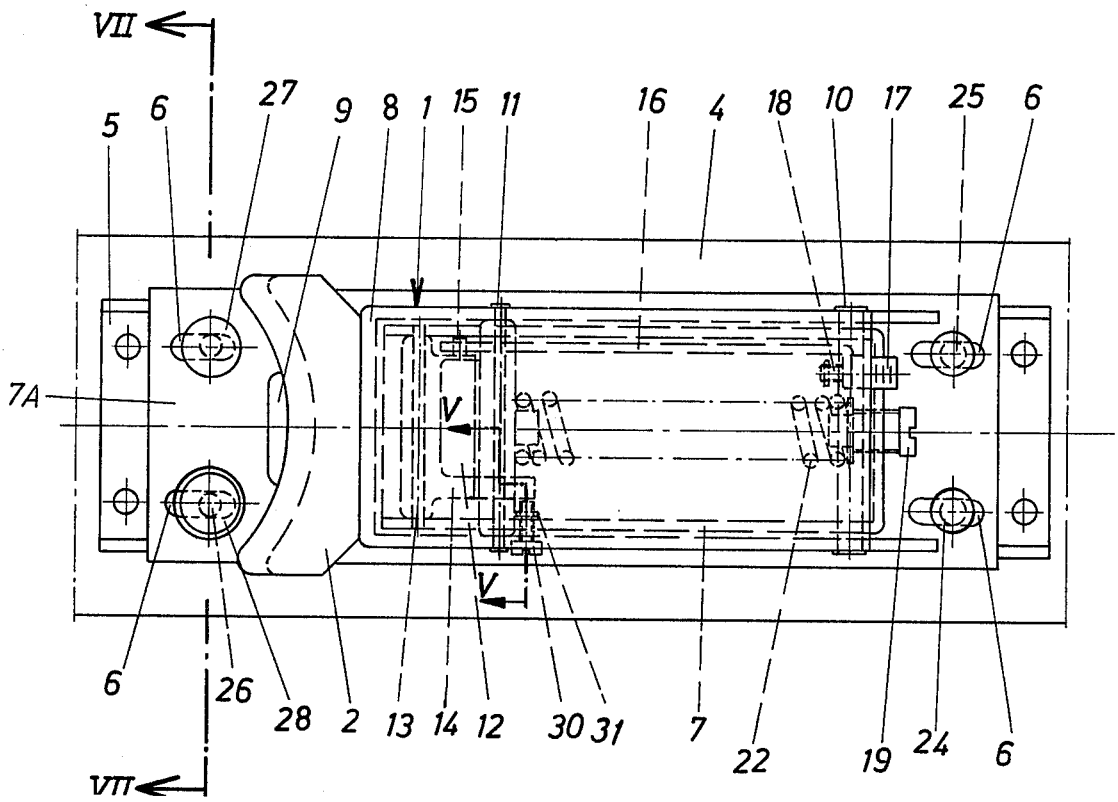
FIG. 2 is a top view of the ski binding.
Figure 3:
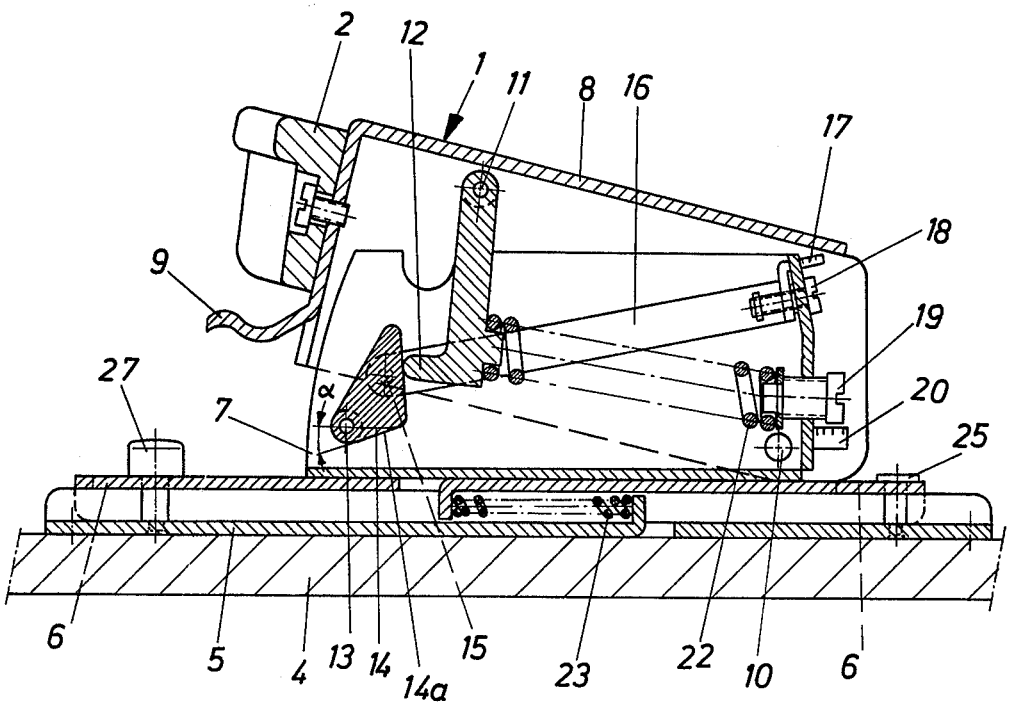
FIG. 3 is a sectional view of the ski binding in the release position.

A heel holder 1 is illustrated in FIGS. 1 to 4 and consists of a base plate 5 which is fixedly mounted on the ski 4 and has guide bolts 24, 25, 26 and 27 mounted thereon. A housing 7 includes a plate 7A having slots 6 therein extending in the longitudinal direction of the ski. The plate is slidingly mounted on said base plate 5 and is guided by the guide bolts received in the guide slots 6. The sole holder 8 is pivotally connected to the housing 7 by a horizontally extending shaft 10, which sole holder has a hold-down device 2 and a stepping spur 9 mounted thereon. A slideway member 14 is pivotally secured in the housing 7 by pivot pin 13. One end of an adjusting lever 16 is pivotally secured to the slideway member by a pin 15, which adjusting lever 16 is reciprocally adjustably operated by a setscrew 18 supported in the rear wall of the housing. By rotating the setscrew 18, it is possible to change the angle of pitch $\alpha$ of a slideway surface **14*a* on the slideway member 14 and to read the angle through a marked indicator 17 secured to and movable with the adjustable lever 16. A locking arm 12 which engages the slideway surface 14*a* is hinged to the sole holder by a hinge pin 11 and is initially tensioned and urged toward and into engagement with the slideway surface 14*a* by a spring 22. The initial tension of the spring 22 in turn can be adjusted by a setscrew 19 and the position thereof is compared to markings on an indicator 20. In addition, a pressure spring 23 is arranged between the base plate 5 and the plate 7A part of the housing 7, which pressure spring initially tensions or urges the housing 7 toward the toe jaw or tip of the ski 4. The heel of the boot 3 is therefore pressed forwardly by the pressure spring 23 and is pressed against the ski by the spring 22 and the locking arm 12. By changing the angle of pitch $\alpha$ of the slideway surface 14*a* on the slideway member 14, the release point and thus the height of elasticity in the binding can be altered and the setscrew 19 effects a separate adjustment of the initial tension in the spring 22** and thus the holding force of the sole holder.

The slideway surface **14*a* is formed with an obtuse angle as at 14*c*** to achieve an exact release point.

Figure 4:
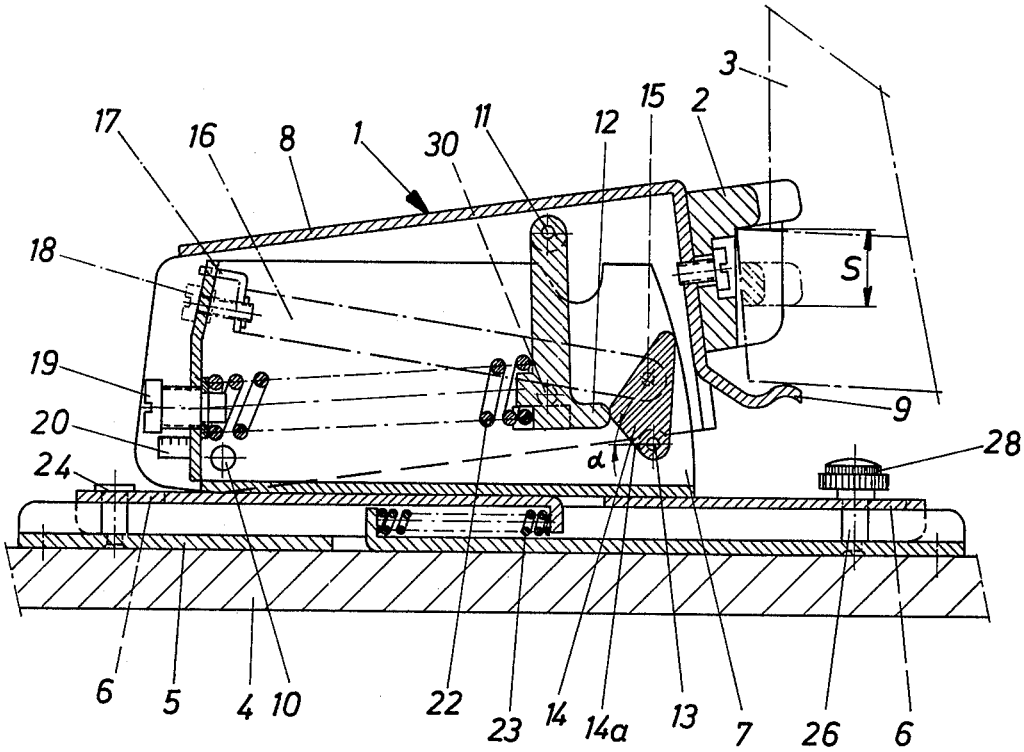
FIG. 4 illustrates the ski binding in a cross-country condition of use.
Figure 5:
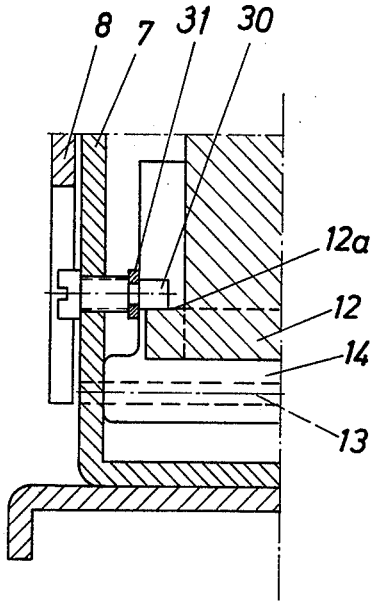
FIG. 5 is a fragmentary view taken in the plane V—V of FIG. 2.

In FIGS. 4 and 5, the heel holder 1 has a stop part 30 thereon which limits the release movement of the locking arm 12 and the ski boot cannot be released by the sole holder 8. For this adjustment, which is required for cross-country skiing, the slideway member 14 is moved into a position permitting the greatest possible height of elasticity. The ski boot can be released by increasing the stop part 30 until its locking member 31 touches the housing 7.

Figure 6:
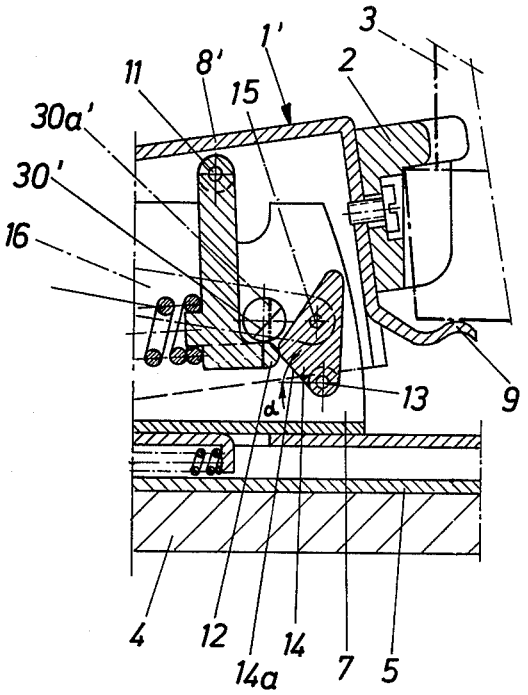
FIG. 6 is a further fragmentary view of a modification of the stop part which blocks the locking arm.

FIG. 6 illustrates a further possibility of construction of the stop part 30. The stop part 30 is rotatable on its axis having a sloped part by which "free" and "closed" positions respectively can be adjusted (see the full and dash-dotted lines). The initial tension of the spring 22 is preferably reduced during adjustment for cross-country skiing so that the heel of the boot 3 can be moved relatively easily.

Figure 7:
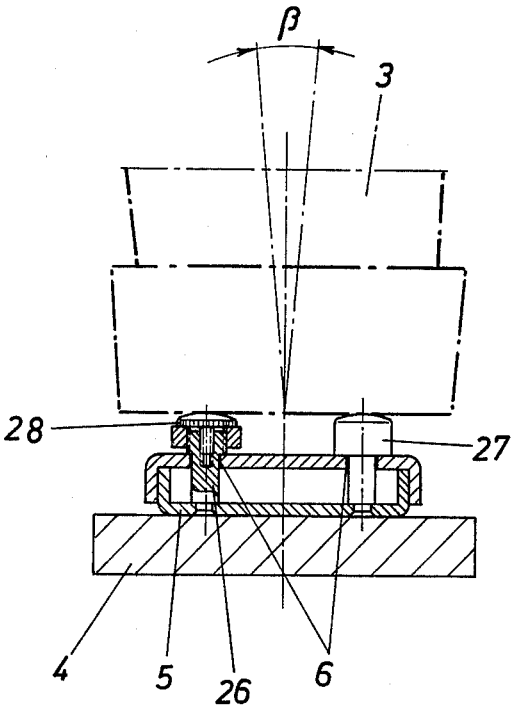
FIG. 7 is a sectional view taken in the plane VII—VII of FIG. 2.

FIG. 7 illustrates a detail for correcting the leg adjustment through the angle $\beta$ wherein the boot sole 3 rests on an adjustable setscrew 28 which is screwed into the guide bolts whereby the sloped position of the boot sole can be adjusted.

A separate positioning of the slideway member 14 and adjustment of the tension in the spring 22 results in a complete separation of the height of elasticity adjustment on the one hand and the release or holding force on the other hand.

Figure 8:
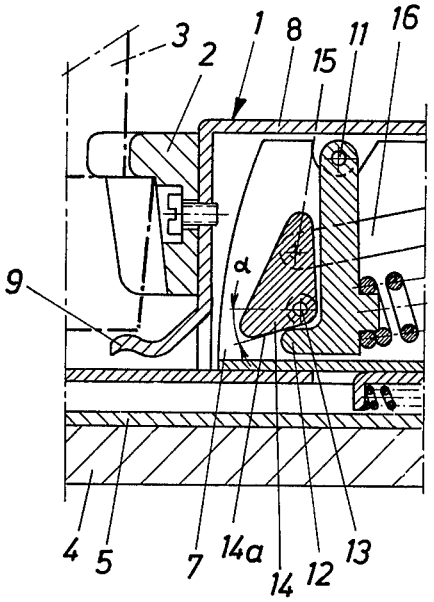
FIG. 8 is a further fragmentary view of FIG. 2.

In FIG. 8, the pivot pin 13 is located at a different location from that illustrated in the embodiments of FIGS. 1 to 4, 6 and 9. This embodiment gives a direct support from the locking arm 12 to the pivot pin 13.

Unless the heel binding is in the cross-country skiing position of use, the toe jaw permits pivoting of the toe of the ski boot relative to the ski as known per se in Swiss Pat. No. 252 152.

In contrast to this, FIG. 9 illustrates a combined adjustment structure for adjusting the slideway angle $\alpha$ and the initial tension of the spring 22. For this purpose, the spring 22 and the adjusting lever 16 are each supported on a regulating plate 33 by a holding bolt or a pin. The regulating plate 33 is in turn connected to the housing 7 through an adjustble setscrew 36. The position of the regulating plate 33 is visually displayed through an indicating mark 35 thereon and its relative position to the housing 7. The holding bolt 34 on the regulating plate 33 is preferably to additionally control the tension in the spring 22 and designed as a setscrew. By suitably selecting the individual arm lengths of the lever, it is now possible to maintain the release force constant upon rotation of the adjusting screw 36, while the height of elasticity is varied. The binding can therefore be adjusted in a simple manner to the respective slope conditions because of the absorption capability of the binding for shock load changes depending on the height of elasticity at the same release force. The adjustment of the release force is accomplished by changing the initial tension of the spring 22 for the respective skier.

FIG. 10 illustrates a particular curve shape for the slideway surface **14*b*** which is associated with the closed position. It can be easily seen that by selecting the curve shape of this part of the slideway surface, which defines a function curve K, the course of the release force or of the height of elasticity can structurally be influenced during the release operation. Also it is possible to maintain the release force constant through a suitable design.

FIG. 11 illustrates a further exemplary embodiment, in which the pivot point 13 of the slideway member 14 is selected such that by changing the setscrew 18 and thus by changing the position of the slideway member both the angle of pitch $\alpha$ of the slideway surface **14*a* and also the initial tension of the spring 22** can be changed.

A number of examples of use or constructions which are designed for special cases of use are possible within the scope of the invention.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A heel holder for a safety ski binding for use on the upper surface of a ski, comprising:

a base member having means defining a locking projection thereon, said locking projection having an inclined slideway surface thereon, the inclination of which is variable relative to said upper surface of said ski;

sole holder means pivotally supported to said base member for movement about a pivot axis;

a locking member pivotally supported on said sole holder means, said locking member having lip means thereon extending beneath said locking projection when said sole holder means is in a position of use;

resilient means extending between said base member and said locking member to resiliently urge said locking member into engagement with and beneath said slideway surface, said locking projection being maintained beneath said locking projection and in engagement with said locking surface by the force of said resilient means; and adjustment means for adjusting and fixably locating the inclination of said slideway surface in selected positions relative to said upper surface of said ski.

2. The heel holder according to claim 1, wherein said resilient means includes a compression spring, said heel holder including control means for controlling the initial tension of said spring.

3. The heel holder according to claim 2, wherein said slideway surface is provided on a slideway member which includes means rotatably supporting same on said base member.

4. The heel holder according to claim 3, wherein said locking member is constructed L-shaped with one leg of the L extending beneath said locking projection on said base member.

5. The heel holder according to claim 1, including a stop part supported on said base member and being selectively movable into and out of a release path of movement of said locking member.

6. The heel holder according to claim 1, wherein said slideway surface has two partial tracks thereon which define an obtuse angle, one track being associated with said position of use of said ski binding and the other track being associated with the open position of said ski binding.

7. The heel holder according to claim 1, wherein said base member includes a housing and a base plate, said base plate being fixedly secured to said upper surface of said ski and includes support means for movably supporting said housing for movement in a direction parallel to the longitudinal axis of said ski, said sole holder being pivotally supported on said housing.

8. The heel holder according to claim 7, including second resilient means for urging said housing toward the tip of said ski relative to said base plate.

9. The heel holder according to claim 1, wherein said adjusting means includes means for effecting a stepless adjustment.

10. The heel holder according to claim 9, wherein said stepless adjustment means includes a threaded screw.

11. The heel holder according to claim 7, wherein said rotatable mounting means secures said slideway member to said housing.

* * * * *

UNITED STATES PATENT AND TRADEMARK OFFICE

CERTIFICATE OF CORRECTION

PATENT NO. : 4 103 930

DATED : August 1, 1978

INVENTOR(S) : Alfons Valoh

It is certified that error appears in the above-identified patent and that said Letters Patent are hereby corrected as shown below:

Column 4, line 62; change "1" to ---3---.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*